US007744353B2

(12) United States Patent
Yamada et al.

(10) Patent No.: US 7,744,353 B2
(45) Date of Patent: Jun. 29, 2010

(54) FLUID PUMP AND HIGH-PRESSURE FUEL FEED PUMP

(75) Inventors: Hiroyuki Yamada, Hitachinaka (JP); Atsuji Saito, Hitachinaka (JP); Masayoshi Kotaki, Hitachinaka (JP); Hiroshi Odakura, Hitachiota (JP); Masami Abe, Hitachi (JP)

(73) Assignees: Hitachi, Ltd., Tokyo (JP); Hitachi Car Engineering Co., Ltd., Hitachinaka-shi (JP)

( * ) Notice: Subject to any disclaimer, the term of this patent is extended or adjusted under 35 U.S.C. 154(b) by 1014 days.

(21) Appl. No.: 10/250,488

(22) PCT Filed: Jan. 5, 2001

(86) PCT No.: PCT/JP01/00020

§ 371 (c)(1),
(2), (4) Date: Jul. 3, 2003

(87) PCT Pub. No.: WO02/055881

PCT Pub. Date: Jul. 18, 2002

(65) Prior Publication Data

US 2004/0052652 A1 Mar. 18, 2004

(51) Int. Cl.
*F04B 1/04* (2006.01)
*F04B 27/04* (2006.01)

(52) U.S. Cl. ..... 417/273; 417/470; 417/569

(58) Field of Classification Search ..... 417/273, 417/470, 569

See application file for complete search history.

(56) References Cited

U.S. PATENT DOCUMENTS

| | | | | |
|---|---|---|---|---|
| 4,811,716 | A * | 3/1989 | Guntert et al. | 123/503 |
| 4,881,763 | A | 11/1989 | Guido et al. | |
| 5,921,760 | A * | 7/1999 | Isozumi et al. | 417/470 |

FOREIGN PATENT DOCUMENTS

| | | | |
|---|---|---|---|
| GB | 2038975 | A | 7/1980 |
| JP | 52-25928 | | 2/1977 |
| JP | 55-93960 | A | 7/1980 |
| JP | 63-87266 | | 6/1988 |
| JP | 10-184483 | | 7/1998 |
| JP | 10-184494 | | 7/1998 |
| JP | 11-82236 | | 3/1999 |
| WO | WO 00/47888 | | 8/2000 |
| WO | WO 2006/069819 | A1 | 7/2006 |

* cited by examiner

*Primary Examiner*—Devon C Kramer
*Assistant Examiner*—Patrick Hamo
(74) *Attorney, Agent, or Firm*—Crowell & Moring LLP

(57) ABSTRACT

A fluid pump has a cylinder supporting a plunger and a pump housing formed with dissimilar metals. A pressing mechanism presses the cylinder and the pump housing relative to each other so that a pressurizing chamber is sealed through a pressing surface between the pump housing and the cylinder. The number of seal points can be reduce, and a reduction in reliability can be eliminated while realizing a reduction in weight of the pump housing and a reduction in cost due to increase in cutting capability, by using a soft material such as an aluminum alloy for the pump housing.

19 Claims, 4 Drawing Sheets

FLUID PUMP AND HIGH-PRESSURE FUEL FEED PUMP

TECHNICAL FIELD

The present invention relates to a pump that transports fluid. For example, the present invention is suitable for a high-pressure fuel (gasoline) supply pump that feeds a high-pressure fuel forcefully to a fuel injection valve of a system that supplies the fuel (gasoline) directly to the combustion chamber of an internal combustion engine.

BACKGROUND ART

In a conventional device, a hollow cylindrical part is provided in a pump housing (called a body or a base) of the pump as a first member. A cylinder (called a plunger support member, a plunger slide tube, or a cylindrical member) as a second member is made to fit the hollow cylindrical part. The pressurizing chamber that pressurizes the fuel is formed by closing the open end of the cylinder using a seal plate. A reciprocation plunger, having a point that goes into and out from the pressurizing chamber, is supported by this second member so as to go in and out.

Such a conventional device, for instance, is proposed as a high-pressure fuel feed pump for an internal combustion engine by Japanese Laid-Open Patent Application No. 11-82236.

This document describes a high-pressure fuel feed pump that can decrease man-hour requirements, while ruining neither wear and abrasion resistance nor liquid seal properties, by making the second member, which keeps the slidable plunger wear and abrasion resistant, and the first member, into which the second member is inserted, of wear and abrasion resistant material like an aluminum alloy.

However, in this prior art, the pressurizing chamber and the low-pressure chamber are sealed by pressing a seal plate, provided at the open end of the cylinder, against the cylinder end surface. Further, the first member and the second member are almost contacted in the opening area of the periphery of the second member. Therefore, a difference in heat deformation amounts is caused according to the difference in the thermal expansion coefficients between both members. As a result, the cylinder receives stress and deforms locally when both members expand due to the effect of heat, and the plunger wears the cylinder. Further, the space between the plunger and the cylinder wall surface is about five microns. An average thermal expansion coefficient of the aluminum alloy member is $23\times10^{-6}$. Moreover, an average thermal expansion coefficient of an iron system member is $10\times10^{-6}$ for steel, and $17\times10^{-6}$ for SUS. If the diameter (inside diameter or outside diameter) is 30Φ, thermal expansions of 7 microns, 3 microns, and 5 microns are caused, respectively, because the amount of thermal expansion is obtained by diameter×thermal expansion coefficient×temperature variation difference. These thermal expansions act on the outside wall of the cylinder, and cause deformation of the cylinder.

Moreover, because it is necessary to assemble the first and second members so that they do not come off, and with many seal rings installed between the first member and the second member, assembly of the first member and the second member is difficult, and not practicable.

Further, the plunger in the above-mentioned prior art document might be referred to as a piston or a reciprocating rod in other documents. The plunger of the present invention is the same as these members. Of course, it is possible to functionally refer to the element by which the fluid is pressurized.

Therefore, both a plunger with a rod shape or another pressurizing element having the function of compressing the fluid can be used.

Both an element with the rod shape described and also an element of a shape having a pressurizing function that is not described are included in the term "pressurizing element" in this application.

DISCLOSURE OF INVENTION

An object of the present invention is to provide a high-pressure fuel feed pump with few seal parts between a first member and a second member, while maintaining the advantage in the above-mentioned prior art of decreasing the man-hour processing time, as well as keeping abrasion resistance and liquid seal properties.

Moreover, another object of the present invention is to provide a high-pressure fuel feed pump that, regardless of the quality of material of the first member and the second member, provides both members with excellent assembly characteristics.

Further objects of the present invention are to decrease the contact of the pump housing and the cylinder, formed by members with different thermal expansion coefficients, suppress the generation of the local stress caused by the difference in the amounts of the thermal expansion, and control the deformation of the cylinder.

A further object of the present invention is to provide a high-pressure fuel feed pump in which there is no need to make a discharge opening to discharge the high-pressure fluid for the cylinder made of the hard metal.

To achieve at least one of the above-mentioned objects, according to this invention, a pressing mechanism is provided to press the first member and the second member on the surface that intersects with the direction in which the plunger goes into and back from (preferably, the surface perpendicular to the direction of going in and out). A metal seal provided by the pressure-contact of both metals or a metal seal provided where another metallic component is inserted is formed on this pressure-contact surface. The pressurizing chamber formed between the first member and the second member is sealed with this metal seal.

As a result, excellent seal performance can be obtained without providing either the seal ring or the gasket between the first member and the second member. Assembly work becomes very easy.

Because adhesion is not demanded on opposing surfaces of both members (especially on an exterior side) except at the pressure-contact surfaces or the sealing part, sufficient space can be provided. As a result, even when both members are formed with different thermal expansion coefficients, stress provided by a thermal expansion difference is not readily generated.

Moreover, as a mechanism that can easily assemble the second member to the first member, the mechanism that houses the second member in the holder with the screw and screws it to the first member is proposed in the present invention.

Specifically, it is convenient if this mechanism composes the pressing mechanism.

In addition, a configuration by which generation of stress by the thermal expansion difference between the first member and the second member is controlled is also proposed in the present invention.

Therefore, a concave part for the pressurizing chamber is formed in the pump housing in the present invention. The pressurizing chamber is formed by sealing up the opening of this concave part with the cylinder. The pump case and the cylinder need not come in contact in a part other than the contact part in the sealing surface if they are composed in this manner. Therefore, local generation of the thermal stress can be reduced, even when the members with different thermal expansion coefficients are used for both members, and deformation of the cylinder can be controlled.

Because the intake valve mechanism of the pump and the delivery valve mechanism are installed in the pump housing according to another feature of this invention, it is possible to form the openings for the discharge port and the inlet port in the pump housing of a comparatively soft metallic member. As a result, the processing is significantly improved.

The fluid transportation pump is targeted for broad rather than narrow applications and is not limited to high-pressure fuel pump technology.

BEST MODE FOR CARRYING OUT THE INVENTION

The configuration and the operation of one embodiment of a high-pressure fuel feed pump that adopts the present invention are explained with reference to FIG. 1 and FIG. 2. This high-pressure fuel feed pump is regarded as a fluid transportation pump that handles gasoline pressurized from 5 to 20 mega Pascal as the pressurizing fluid. Therefore, this differs from a pump that can handle a high-pressure fluid of more than 100 mega Pascal, like a high-pressure fuel pump for a compression ignition oil engine. Moreover, this differs from a feed pump in which fluid is transported by pressure that is slightly higher than the atmospheric pressure.

Further, this differs from the device that compresses the gas, like the compressor of a refrigerating cycle.

Figure 1:
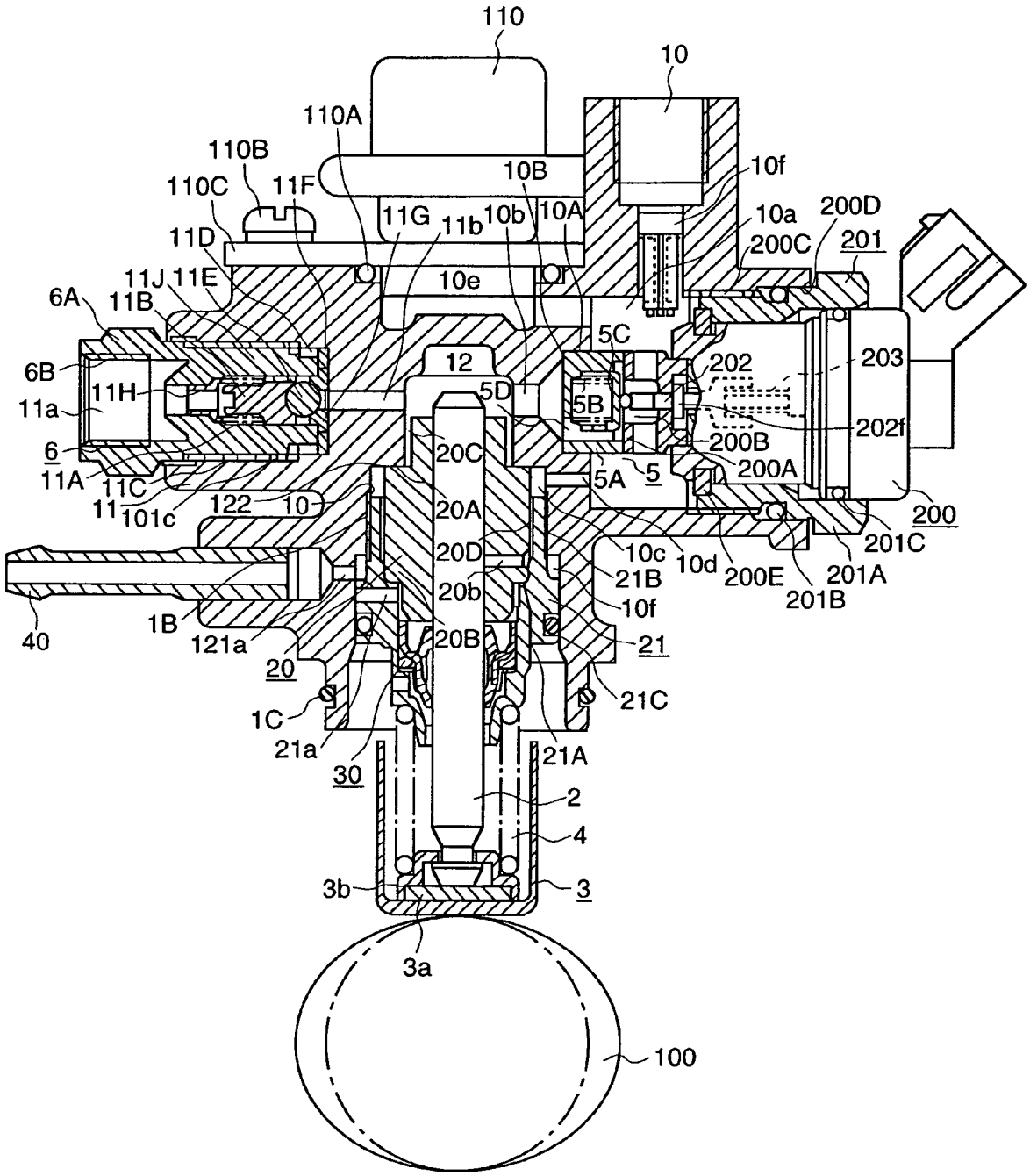
FIG. 1 is a vertical sectional view of a high-pressure fuel feed pump according to one embodiment of the present invention.
Figure 2:
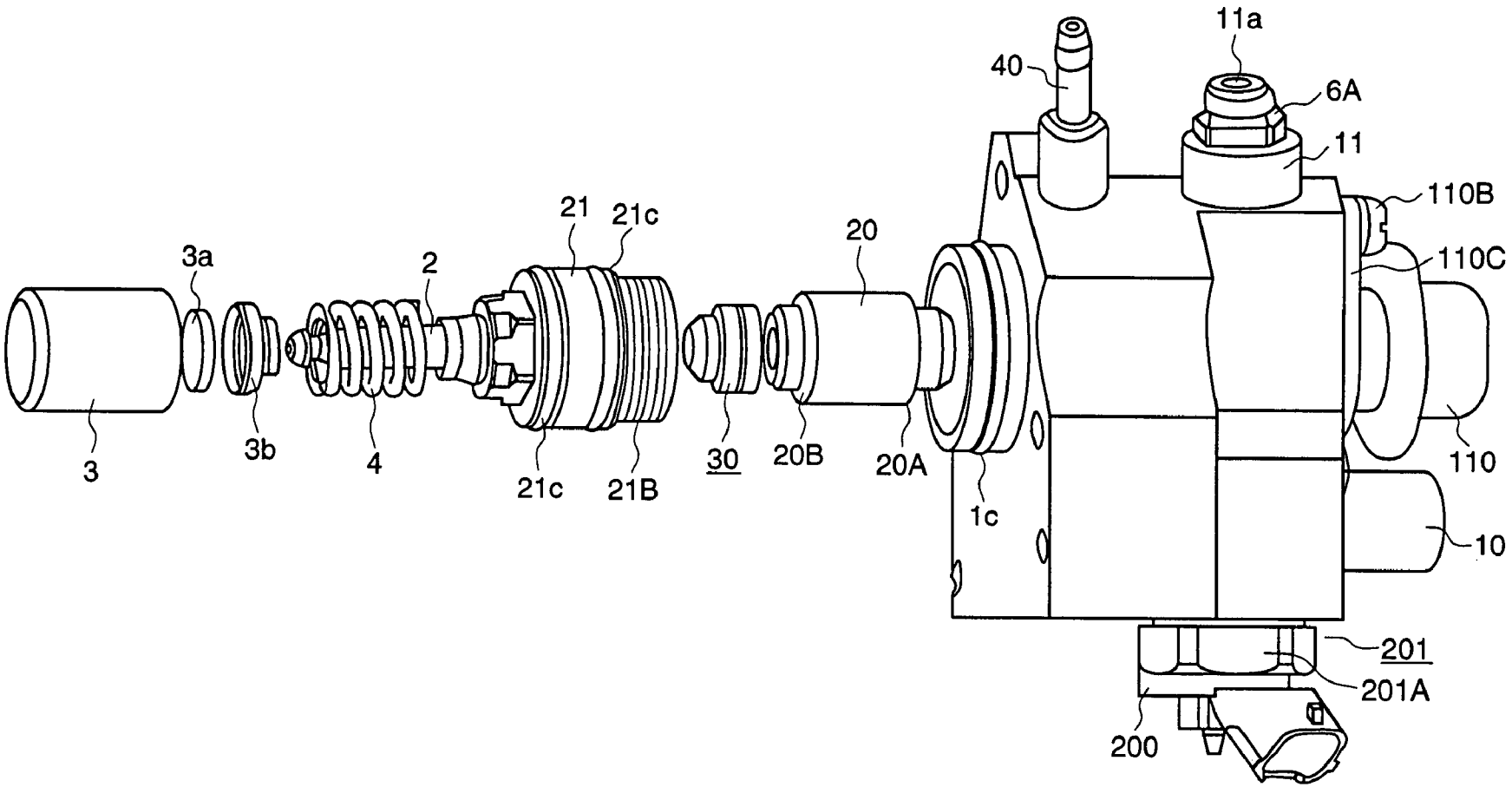
FIG. 2 is an exploded perspective view of the high-pressure fuel feed pump of FIG. 1.

FIG. 1 is a vertical sectional view of the entire pump and FIG. 2 is an exploded perspective view of the pump shown in FIG. 1.

Pump p is provided with a pump housing 1 (called a body or base) as a first member and a cylinder 20 (called a plunger support member, a plunger slide tube, or a cylindrical member) as a second member.

The pump housing 1 is made of a light material, softer (the hardness is low, for instance, 45-70 in HRB) than stainless steel and iron materials like tool steel, as well as aluminum or an aluminum alloy (for instance, JIS standard A2017, ADC12, or AC4C). In addition, the member shows non-abrasion resistance and large thermal expansion coefficient ($23\times10^{-6}$ or more, for instance).

The cylinder 20 can be made of a hard, heavy-weight alloy (having a high hardness, for instance, of 200 HRB or more) with abrasion resistance, as well as, from stainless steels and tool steels, and has a small thermal expansion coefficient (for instance, $17\times10^{-6}$ or less in SUS, and $10\times10^{-6}$ in iron).

The cylinder 20 is assembled into the pump housing 1 in such a way that an annular plane 20A formed in the periphery of cylinder 20 contacts an annular plane 122 at the open end of concave part 121 of pump housing 1, which has a bottom. Consequently, both form the metal interface of the aluminum material and the iron-system material on the annular planes.

A through tube 201, in which plunger 2 is inserted, is formed at the center of cylinder 20. A plunger 2 is supported so as to be able to slide in this through tube 201, and the plunger 2 can go in and out axially.

Thus, the bottom-having concave part 121 of pump housing 1 forms space 12 into which plunger 2 goes and back from which the plunger comes between the point of cylinder 20 and itself. The space 12 functions as a pressurizing chamber to pressurize the fuel fluid inhaled there by plunger 2. The hardness of cylinder 20 is higher than that of the pump housing 1 as described above. Moreover, the annular plane 122 of pump housing 1 and the annular plane 20A of cylinder 20 is relatively pressed by the pressing mechanism described later. Therefore, the annular plane 122 of pump housing 1 is subject to plastic deformation at the part where the annular plane 20A of cylinder 20 is contacted. Both are strongly pressed in that part, and the seal by the surface contact of the metal is formed.

Thus, space 12 into which plunger 2 goes and back from which the plunger comes is formed as a closed chamber divided with intake valve, the delivery valve, and this seal. As a result, action as pressurizing chamber 12 of the fuel pump is possible.

A fuel inlet port 10 and a discharge port 11 are formed in the pump housing 1 made of the aluminum alloy. The fuel inlet port 10 is connected to the pressurizing chamber 12 through inlet chamber 10*a* and inlet port 10*b*.

The discharge port 11 is connected to pressurizing chamber 12*a* through discharge port 11*b*. A delivery valve unit 6, explained later in detail, is installed in discharge port 11.

Inlet chamber 10*a* and inlet port 10*b* are formed by cutting or drilling pump housing 1 made of the aluminum alloy.

The cylindrical processing opening 10A, with larger diameter than inlet port 10*b*, is formed at the entrance of inlet port 10*b* formed as a through tube with small diameter.

A cylindrical intake valve unit 5 is installed in this the cylindrical processing opening 10A.

Intake valve unit 5 has an intake valve holder 5A with a disk bottom and a surrounding cylinder wall, and intake valve 5C with a disk bottom opposite to the holder 5A and a surrounding cylindrical wall. Spring 58, which is a coil spring, is installed between the opposed bottoms of the intake valve holder 5A and the intake valve 5C.

Figure 3:
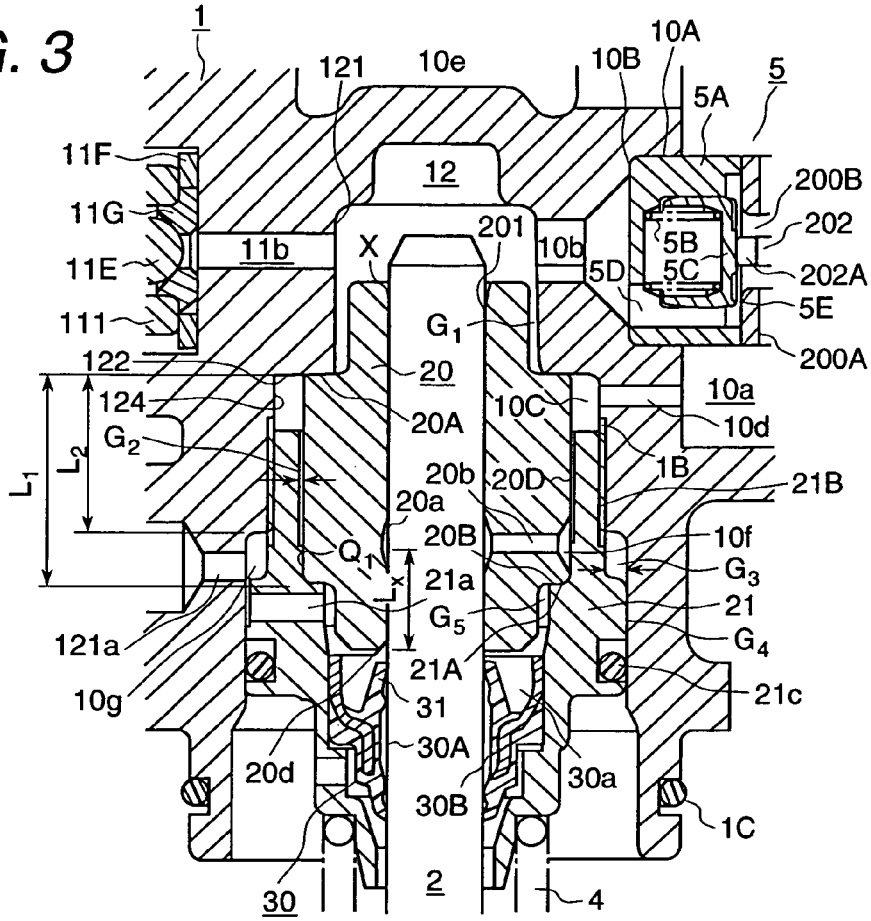
FIG. 3 is a partially enlarged view of FIG. 2.

A plurality of through tubes 5D is provided at suitable intervals in the disk bottom of the intake valve holder 5A (one of them appears in FIG. 3).

The intake valve holder 5A is made of stainless steel. Pressure-contact surface 10B between this holder and pump housing 1 forms a seal part, by way of the metal surface contact, as well as the pressure-contact surface between the pump housing 1 and the cylinder 20.

A valve seat member 200A contacts so as to close the open end of the intake valve holder 5A.

A through tube 200B, which connects the inlet chamber 10*a* and the inlet port 10*b*, is formed at this center of the seat member 200A.

This through tube 200B can be blockaded by the intake valve 5C that is energized by a spring 58.

The annular projection 5E is formed in the end surface facing the seat member 200A of the intake valve 5C. This annular projection 5E is arranged concentrically of through tube 200B at the center of the seat member 200A. This annular projection 5E contacts the end surface of the seat member 200A, and through tube 200B is blocked.

The seat member 200A is located near the end of a movable plunger of electromagnetic plunger mechanism 200.

Electromagnetic plunger mechanism 200 is installed in cylindrical concave part 200D formed in the pump housing 1 by cutting. Threaded part 200 C is formed in the inner wall of cylindrical concave part 200D. Electromagnetic plunger mechanism 200 is assembled in a holder 201 with a screw engaged to this threaded part 200 C.

A fixed ring 200E is installed in the annular groove formed in the periphery of the electromagnetic plunger 200. The outer corner part of this ring 200E is connected to the annular concave part formed inside the point of holder 201.

Thus, electromagnetic plunger 200 is installed in holder 201 with the screw. When the nut 201A of holder 201 with the screw is rotated, the seal member 200A is pressed against intake valve unit 5 through a ring 200E engaged to the annular concave part of the holder 201. After that, intake valve unit 5 is pressed against the pump housing 1, and these parts are installed in pump housing 1.

At this time, it is possible to adjust the power by which the seat member 200A, installed at the point of electromagnetic plunger mechanism 200, presses the intake valve unit 5 against pump housing 1 by adjusting the tightening power of the nut 201A.

And, this power contributes to the formation of the seal by the metallic pressure-contact between the intake valve unit 5 and the pump housing. Therefore, the holder 5A of the intake valve unit 5 is formed with harder material than the aluminum alloy like stainless steel.

When the electromagnetic plunger mechanism 200 is in a turn-off state, the movable plunger 202 resists the power of spring 5B using a spring 203 and maintains the intake valve 5 in opening position.

At this time, the movable plunger 202 of the electromagnetic plunger mechanism 200 extends via the through tube 200B of the seat member 200A to the intake valve 5C. The plane part of hemispherical ball 202A provided at the point of movable plunger 202 contacts to the intake valve 5C. Further, the spring 5B is pushed, and the intake valve 5C is pulled apart from the seat member 200A. As a result, the inlet chamber 10*a* and the intake port 10*b* are led via the through tube 5D and the through tube 200B.

The movable plunger 202 resists the power of spring 203 at the turn-on and attraction of electromagnetic plunger mechanism 200. At this time, the intake valve 5C is controlled to the closed position or the open position in accordance with the relationship between spring 5B and the pressure difference of the fuel in the upstream and downstream of the intake valve 5C.

The inlet port 10 that leads to inlet chamber 10*a* is formed in the pump housing 1. Moreover, filter unit 10*f* is installed between the inlet port 10 and the inlet chamber 10*a*.

A dumper chamber 10*e* that leads to inlet chamber 10*a* is formed in the periphery of the pressurizing chamber 12 of the pump housing 1.

The dumper chamber 10*e* is closed with a shutting lid 110C fastened to pump housing 1 with screw 110B through a seal ring 110A. Dumper mechanism 110 that adjusts the pressure of the dumper chamber 10*e* is installed in the shutting lid 110C. The dumper chamber in the dumper mechanism 110 leads to dumper chamber 10*e* on the side of the pump housing 1 through the shutting lid 110C.

One edge of the discharge port 11*b*, of which the other edge leads to the pressurizing chamber 12, is open in discharge port 11 formed in the pump housing 1.

The discharge port 11 is formed in the pump housing 1 as a larger volume 11D than the diameter of discharge port 11*b*. A threaded part 101 C is formed in a surrounding wall of the volume 11D.

A discharge port unit 6 is installed in this discharge port 11.

The delivery valve unit 6 includes a ball valve 11E energized by the spring 11A in the metal nipple 6A.

A screw 6B is formed inside of one edge of the metal nipple 6A. The fuel piping not shown in the figure is connected with this screw 6B.

Moreover, a screw 11 C connected with the threaded part 101C formed in pump housing 1 is provided outside of the metal nipple 6A.

The fuel passage with a small diameter penetrates to an internal center of the metal nipple 6A, and the step part is formed in the surroundings.

A flanged and cylindrical spring bearing 11H are installed in the fuel passage, and the flange part contacts the step part.

One edge of the spring 11A is received by this flange part.

The other edge of the spring 11A is supported in the peripheral step of the valve guard 11B.

The valve guard 11B is an elongated and solid tube, and a plurality of communicating grooves 11J are formed in an axial direction and in a circumferential direction. When the delivery valve 11E opens, the fuel flows from the discharge port 11*b* to discharge opening 11*a* through this communicating groove 11J.

Although the delivery valve 11E is always energized in the closed direction by the spring 11A, delivery valve 11 is open when the pressure in the pressurizing chamber 12 exceeds the thrust-pressure power of the spring 11A and the fuel pressurized to the high pressure is discharged from the discharge port 11 (discharge opening 11*a*).

Pressurizing chamber 12 includes the passage to intake valve 5 including the inlet port 10*b*, and the passage to the delivery valve 11E includes the discharge port 11*b*.

A valve seat 11G and a seal ring 11F are arranged concentrically in order from the inside between the delivery valve unit 6 and the pump housing 1.

The valve seat 11G and the seal ring 11F are interposed between the pump housing 1 and the point of the delivery valve units 6 by the pressing power generated in an axial direction when the screw 11C for delivery valve unit 6 is inserted into the threaded part of pump housing 1.

The size of the edge of discharge port 11*b* of the delivery valve unit 6 is set so that the inside diameter may be smaller than the outside diameter of the valve seat 11G and the outside diameter may be larger than the inside diameter of the seal ring 11F.

As a result, both valve seat 11G and seal ring 11F can be pressed against the pump housing by one ring part at the point of the delivery valve unit 6.

Here, the valve seat 11G is formed with the steel member. Moreover, the seal ring 11F is formed with soft metal material like the aluminum alloy or the gasket. Because the first seal formed by the metal surface contact of the valve seat 11G and the pump housing 1 and the second seal formed with the seal ring 11F and the pump housing 1 in the periphery of the first seal exist in such seal structure, the seal becomes certain.

Concretely, even when the cavitation generated by the collapse of the void of a high-pressure fuel acts between the contact surface of the first seal formed by the metal surface contact of the valve seat 11G and the pump housing 1, the pump housing of soft metallic material is invaded, and the first seal is broken, it is possible to prevent the leakage to the outside by the second seal.

Reliability against the destruction of the seal of the delivery valve improves because the first seal becomes a protector even in such a state, and cavitation of the pressurizing fuel does not reach the second seal.

Because the fuel leaks directly to the atmosphere by the seal destruction in the delivery valve, the improvement of reliability against seal destruction in the delivery valve in this embodiment provides an important effect.

The assembly mode of the pump housing 1 and the cylinder 20 is explained next in detail.

A cylindrical surrounding wall 124 with larger diameter than the diameter of the concave part 121 having a bottom is provided on the open end side of the concave part 121 (which forms the pressurizing chamber for the pump) of pump housing 1.

As a result, the step part is provided between the cylindrical surrounding wall 124 and the concave part 121, and an annular plane 122 is formed therein.

Moreover, a screw groove 18 is formed in the inside part of the cylindrical surrounding wall 124.

Plunger 2 is inserted in a through tube 201 provided at the center of cylinder 20, and is supported slidably.

As a result, the plunger 2 is supported by cylinder 20, reciprocation is permitted, and its point goes into and back from in the pressurizing chamber 12.

The cylinder 20 is formed cylindrically as a whole, and the outside diameter at the pressurizing chamber side is smaller than the diameter of the surrounding wall in the concave part of the pump housing 1 having the bottom. The outside diameter of the middle part of the cylinder 20 is larger than the inside diameter of the annular plane 122 of the pump housing 1.

Therefore, the step part is made between the point part and the middle part located on the pressurizing chamber side in the periphery of the cylinder 20, and the annular plane 20A is formed therein.

This annular plane 20A is defined as a plane that intersects in a shift direction of the plunger 2. This plane can be made not only as a perpendicular plane with respect to a center axle of plunger 1 but also as an inclined plane if it is necessary for the practical use.

A similar step part is formed at the edge on the opposite side of cylinder 20, and annular plane 20B is formed therein.

Cylinder 20 is assembled in the pump housing and housed in cylinder holder 21.

Therefore, screw 21B is formed outside of cylinder holder 21. The annular plane 21A, of which the diameter is smaller than the outside diameter of annular plane 20B of cylinder 20, is formed on the inside.

The cylinder 20 is supported in the cylinder holder 21 by the contact of the annular plane 20B and the annular plane 21A of the cylinder holder 21 when the cylinder 20 is inserted in the cylinder holder 21.

When the threaded part 21B of the cylinder holder 21 is connected to the threaded part 1B of the pump housing 1, the cylinder 21 is fixed to the pump housing 1 with the cylinder 21 being interposed between the annular plane 122 of the pump housing and the annular plane 20B of the cylinder holder 21.

At this time, the relative thrust-pressure power between the annular plane 122 of the pump housing 1 and the annular plane 20A of the cylinder 20 can be adjusted to thrust-pressure power suitable to form the seal by adding and subtracting the screw fastening power to the pump housing 1.

Figure 4:
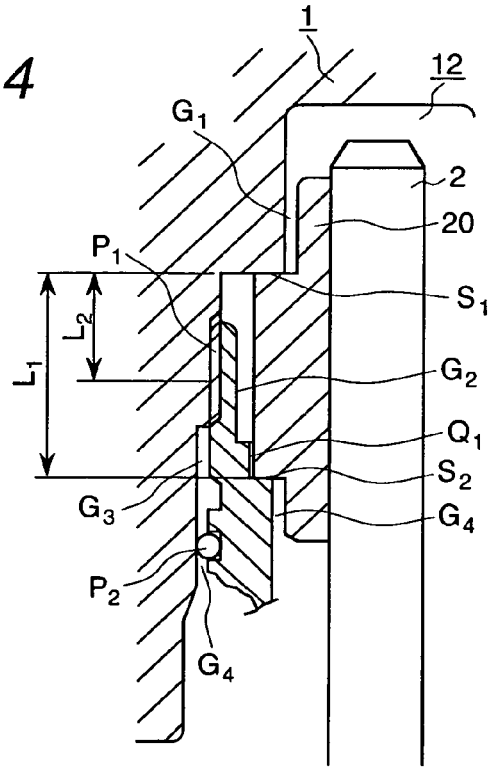
FIG. 4 is a view to explain a feature of this embodiment.

Deterioration of the sealing properties of the pump housing and the cylinder produced by the difference of the amount of thermal deformation caused in an axial direction by the difference of the thermal expansion coefficients of the pump housing 1 and the cylinder 20 is improved in this embodiment. The mechanism providing the improvement is explained in detail with reference to FIG. 4 hereafter.

The distance between the pressure-contact surface S1 of the pump housing 1 and the cylinder 20, and the pressure-contact surface S2 of the pump housing 1 and the cylinder holder 21, is L1. On the other hand, the distance between the pressure-contact surface S1 of the pump housing 1 and the cylinder 20, and the middle point of screw fastening part P1 of the pump housing 1 and the cylinder holder 21, is L2.

Here, the screw fastening part P1 is provided at the position where these two distances L1 and L2 satisfy the relationship of L1>L2 in this embodiment.

Because the members with different coefficients of linear expansion (aluminum material>steel material) are used in this embodiment, with the aluminum material used for pump housing 1 and the steel material used for cylinder 20 in this embodiment, an amount of the thermal expansion generated in an axial direction of the pump housing is larger than that of the cylinder. Therefore, the difference (ΔL1−ΔL2) of both amounts of the expansion can increase if both distance L1 and L2 are equal, the space occurs in the pressure-contact surfaces S1 and S2, and the seal decreases.

Then, the difference (ΔL1−ΔL2) of both amounts of the expansion is decreased by assuming L1>L2 in this embodiment as described above. As a result, the generation of the space in the pressure-contact parts S1 and S2 is suppressed, and the seal is prevented from being decreased.

An aluminum alloy with a thermal expansion coefficient of about $23\times10^{-6}$ (for instance, JIS standard A2017, ADC 12, AC4C) is used for the pump housing 1 of this embodiment. Moreover, tool steel with a thermal expansion coefficient of $10\times10^{-6}$ is used for cylinder 20.

Therefore, both amounts (Δ1, Δ2) of the thermal expansion are calculated as follows when there is a temperature change of 100° C.

$$\Delta 1 = L1\times10\times10^{-6}\times100(^\circ\text{ C.})$$

$$\Delta 2 = L2\times23\times10^{-6}\times100(^\circ\text{ C.})$$

Both thermal deformation amounts Δ1 and Δ2 can be almost made equal here by setting L1=2×L2. The thermal expansion difference is not generated even if there is a temperature change, and the seal is ruined because the space is not made in the pressure-contact surfaces S1 and S2.

There are provided gap G1 between the outside of the point of cylinders 20 on the pressurizing chamber side and the inside of pump housing 1, gaps G2 and G5 between the inside diameter side of cylinder holder 21 and the outside of the cylinder 20, and gaps G3 and G4 between the inside of the pump housing 1 and the outside of the cylinder holder 21, so that neither pump housing 1 nor cylinder 20 may come in contact directly in a radial direction.

The cylinder holder 21 and the cylinder 20 have a circumferential engagement part Q1 for positioning in a radial direction. The position of the circumferential engagement part P1 and that of the screw fastening part P1 of the cylinder holder 20 and the pump housing 1 are displaced so as not to overlap in a direction along the cylinder axle line. Namely, the gap G2 is provided inside the screw fastening part P1 and the gap G3 is provided outside the circumferential engagement part Q1.

The threaded part of the cylinder holder 21 is deformed internally within the range of the gap G2 when the pump casing 1 is deformed by the thermal expansion internally, and the influence due to the deformation of the cylinder holder 21 does not reach the circumferential engagement part Q1.

The screw fastening part P1 is provided on the open-end side of the cylinder holder 21 relative to the circumferential engagement part Q1 in this embodiment.

Moreover, because the wall thickness of cylinder holder 21 at screw fastening part P1 is thinner than the wall thickness in the screw engagement part P1 in this embodiment, the deformation due to the thermal expansion of the pump casing 1 is absorbed by deforming the screw fastening part P1, and the influence on the circumferential engagement part Q1 is controlled. Moreover, a little space is provided at the circumferential engagement part Q1 within the range where the positioning of cylinder 20 in a radial direction is not prevented.

This configuration is effective in the control of the tightening power which acts on the cylinder 20 when the screw fastening part P1 is deformed into the direction of the inside diameter by the thermal expansion of the pump housing 1 while securing the coaxiality of the cylinder holder 21 and the cylinder 20.

Thus, the space in the sliding area of the cylinder 20 and the plunger 2 can be kept proper, and burning or the biting of plunger 2 can be prevented according to the above-mentioned configuration.

Moreover, because the material with a thermal conductivity that is smaller than that of the pump housing 1 (the stainless steel member is used in this embodiment) is used for cylinder holder 21, the heat of pump housing 1 is not transmitted easily to cylinder 20. Therefore, this configuration also has the effect of controlling the burning of the plunger 2.

In addition, a resin coating is given to the threaded part of the cylinder holder 21. The heat transfer from the pump housing 1 is decreased further by this configuration.

Moreover, an annular low-pressure chamber 10*c* that leads to an inlet chamber 10*a* through a passage 10*d* is provided outside of cylinder 20.

As a result, the heat transfer from the pump housing 1 to the cylinder 20 is decreased, and cylinder 20 is cooled by the fuel.

Moreover, a plunger seal 30, by which the fuel outflow from the sliding area of plunger 2 to the cam 100 side is prevented and the leakage of oil from the cam side to the plunger sliding area is sealed, is supported inside cylinder holder 21.

Because the cylinder 20 and the plunger seal 30 are connected to the cylinder holder 21 of the same member, the plunger seal 30 and the plunger 2 that forms the sliding member are supported in the same axis. As a result, the seal in the plunger sliding area can be excellently maintained.

Moreover, a plunger seal chamber 30*a* formed on the cylinder open end side of the plunger seal 30 (inside part of the pump) is connected with the fuel bank 20*a* provided in the cylinder 20 through space X in the sliding area of the cylinder 20 and plunger 2, and is connected with the annular chamber 10*c* through a passage 20*b*, a hollow 10*f*, and a passage 20D.

A plunger seal chamber 30*a* at which the atmospheric pressure acts and a low pressure chamber connected with inlet chamber 10*a*, which consists of the hollow 10*f*, the passage 20D, and the annular chamber 10*c* provided in the neighborhood of cylinder 20, are divided.

Moreover, the plunger seal chamber 30 passes the communicating opening 21*a* provided in the cylinder holder 21, the annular chamber 10*g* formed in the periphery of the positioning part Q1 of the cylinder holder 21 and the passage 121*a* provided in the pump housing 1, and leads to a return pipe 40.

The return pipe 40 is connected to the fuel tanks 50 at about atmospheric pressure through return piping not shown in the figure. Therefore, the pressure of a plunger seal chamber 30*a* is almost equal to fuel tank pressure, or the atmospheric pressure, because it leads to the fuel tank 50 through the return pipe 40.

The fuel that leaks from pressurizing chamber 12 through sliding space X between the cylinder 20 and the plunger 2 flows from the fuel bank 20*a* to inlet chamber 10*a* side through the passages 20*b* and 20D.

Because the pressure of a low-pressure fuel is applied from the inlet chamber 10*a* to the fuel bank 20*a*, the pressure is higher than plunger seal chambers 30*a* at the atmospheric pressure through sliding space X. Therefore, the fuel flows from the fuel bank 20*a* to the plunger seal chamber 30*a* at the atmospheric pressure. This fuel flows to the fuel tank 50 through the return pipe 40. However, it is easy to make the fuel a gas because the plunger seal chamber 30*a* at the high temperatures is almost at the atmospheric pressure.

In this embodiment, the distance LX of the sliding space X from the fuel bank 20*a* to the opening of the cylinder 20 on the plunger seal 30 is shorter than the reciprocating and sliding length of the plunger.

As a result, the fuel adhered to plunger 2 in fuel bank 20*a* when plunger 2 is located at the top dead point passes the cylinder opening 20*d* when the plunger 2 is located at the bottom dead center. Therefore, the oil film is secured at the cylinder opening 20*d*, the lubricity is improved, and the wear of the cylinder 20 and the plunger 2 can be decreased.

Moreover, a throttle part 21*b* is provided between the plunger seal chamber 30*a* and the return pipe 40.

It becomes easy for the fuel to stay in the plunger seal chamber 30*a* by restricting the flowing amount of the fuel to the fuel tank 50 from the plunger seal chamber 30*a*. As a result, it is possible to improve the abrasion resistance of the plunger seal 30 and the cylinder opening 20 by the fuel. It is especially effective when the plunger seal 30 is in the upper part from the return pipe 40 when the pump is installed (The top and bottom is reversed in the direction shown in the figure).

A lifter 3 provided at the bottom of the plunger 2 is pressed against a cam 100 by the spring 4.

The lifter 3 resists the spring 4 and is pushed up when the cam 100 is rotated by the engine camshaft etc. and is depressed by the spring 4. Thus, the plunger 2 is supported by the cylinder 20. The plunger 2 slides into and back from in the through tube 201, and changes the capacity of the pressurizing chamber 12.

Moreover, plunger seal 30 that prevents the fuel from flowing out to the side of the cam 100 is provided to the bottom of cylinder 20.

The inlet chamber 10*a*, as a low-pressure fuel chamber, and annular low-pressure chamber 10*c* that surrounds the seal part are provided through the intake valve holder 5A. Further, the dumper chamber 10*e* is provided outside the upper wall of the pressurizing chamber 12.

The fuel does not leak outside the pump even if there is a fuel leakage from the seal with metallic pressure-contact of the metal interface of the cylinder and the pump housing.

Because the cylinder 20 is made of a material of higher hardness than the pump housing 1, cylinder 1 bites into the pressure-contact surface on the side of the cylinder 1, and the seal of the cylinder is improved.

Especially, the seal can be improved further by using softer material like aluminum for the cylinder 1.

In the upper part of pumping chamber 12*a* or a part of pressurizing chamber 12, the low-pressure chamber 10*f* that leads to the inlet chamber 10 is provided. The wall 1*a* is the weakest part of all walls of pressurizing chamber 12.

That is, when the pressure of the pressurizing chamber pressure rises suddenly by some failure, this weakest part is destroyed first, and the high-pressure fuel is discharged into the dumper chamber 10*e*. Therefore, when the pressurizing chamber has an abnormally high pressure, the fuel can be prevented from leaking outside.

Moreover, a solenoid 200 that controls the opening and shutting time of the intake valve 5 is supported in inlet chamber 10*a* by a solenoid holder 210 in this embodiment. Moreover, an annular fuel chamber is formed in the outer periphery of the solenoid coil between the solenoid 200 and the solenoid holder 210.

As a result, the solenoid 200 can be cooled with the fuel. It is possible to provide an annular fuel chamber in the outer periphery of the solenoid without using the solenoid holder.

Moreover, the heat transfer from the pump housing 1 to the solenoid 200 can be decreased by providing a threaded part in the outer periphery of the solenoid holder 210 and engaging it to the pump housing.

The heat of pump housing 1 does not transmit easily to the solenoid 200 by using the material with lower thermal conductivity than the pump housing 1 for solenoid holder 210, and solenoid 200 can be prevented from being damaged by a fire.

In addition, the heat transfer from the pump housing 1 can be decreased further by coating the resin to the threaded part of the solenoid holder 210.

Moreover, the impact force, when turning off, is decreased by gradually decreasing the driving current for the solenoid 200 when turning off, and wear-out at the collision location and breakage can be prevented.

In addition, the operation distance of the actuator of solenoid 200 is set to a distance shorter than the operation distance of the intake valve 5.

As a result, even when the operation time of solenoid 200 (response at OFF) is slow, the intake valve is opened quickly at the change in the pressure of the pressurizing chamber (when shifting from the discharge process to the inlet process). Therefore, the opening space of the intake valve 5 can be secured enough, and the impact force can be decreased, by reducing the operation distance of the solenoid 200.

The decrease in the pressure of the pressurizing chamber at the inlet process can be prevented because the passage resistance of the intake valve 5 is decreased, and generation of the cavitation can be controlled.

The backflow of the high-pressure fuel to the pressurizing chamber by the shutting delay of the delivery valve 6 (when shifting from the discharge process to the inlet process) can be minimized by shortening the operation distance of the delivery valve 6 more than the intake valve 5, and the generation of cavitation in the pressurizing chamber can be controlled.

1C designates a seal ring that seals between the fluid pump and the engine body, and 21C designates a seal ring that seals between the pump housing 1 and the cylinder holder 21.

The outer periphery of cylinder 20 sealed by the seal ring 21C and the plunger seal 30 forms the inlet air passage 10*a*, or the low-pressure chamber connected with a tank 50.

Therefore, even if the fuel leaks from the pressure-contact part of the pump housing 1 and the cylinder 20, the fuel does not leak directly to the atmosphere.

Even when a softer material like aluminum is used for the pump housing, a low-cost and light pump, having a high degree of reliability by improved cutting, can be provided according to the present invention.

Figure 5:
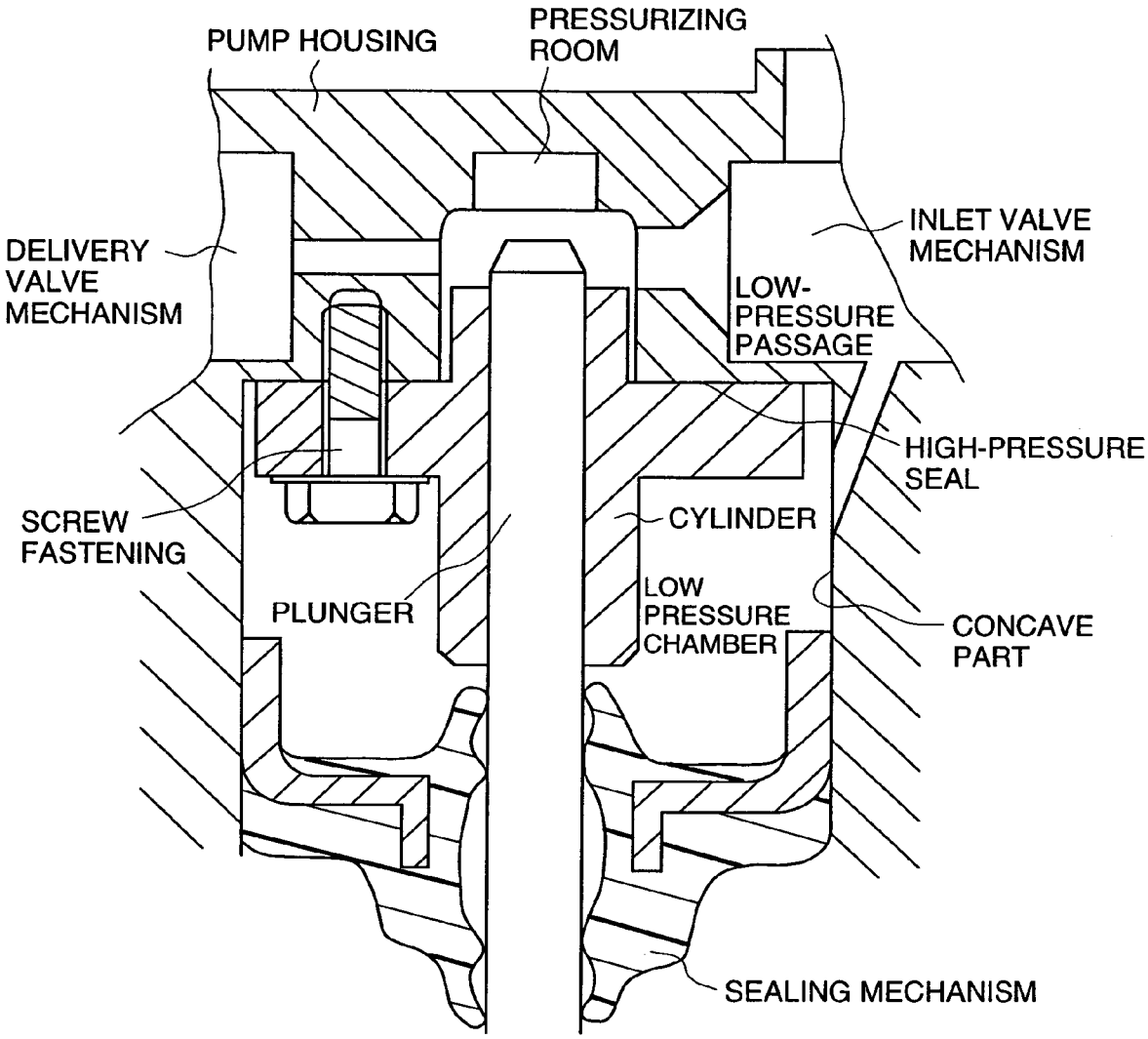
FIG. 5 is a vertical sectional view of a high-pressure fuel feed pump of another embodiment of the present invention.

The point of a basic structure of this embodiment is explained with reference to FIG. 5.

A concave part (having a bottom) that becomes a pressurizing chamber is formed in the pump housing according to the first feature of this embodiment. The concave part is formed as a pressurizing chamber by installing the cylinder in the pump housing.

The cylinder and the pump housing only have to be pressed only in the seal part, and both need not come in contact, especially in the circumferential direction, according to this configuration. That is, the deformation of the cylinder caused by the difference of the amount of the thermal expansion when the pump housing and cylinder is configured by different material can be reduced.

A concave part (having a bottom) that becomes a pressurizing chamber and a low-pressure chamber is formed in the pump housing according to the second feature of this embodiment. The concave part is divided into the pressurizing chamber and the low-pressure chamber by installing the cylinder in the pump housing. The outside of the high pressure chamber is surrounded by the low pressure chamber with the effect of maintaining the above-mentioned first feature by providing a seal mechanism between the opening part of the concave part of the pump housing and the plunger and connecting this low pressure chamber to the inlet passage or the fuel tank. As a result, the possibility that a high-pressure fuel will leak directly to the atmosphere can be reduced.

The invention claimed is:

1. A fluid pump comprising:

a pump housing, a cylinder comprising a longitudinal bore extending from one cylinder end through the cylinder to an opposite cylinder end, and a plunger, supported by the cylinder to reciprocate, which pressurizes fluid in a pressurizing chamber formed between said cylinder and said pump housing and which has an end arranged so as to move beyond said one cylinder end of the cylinder to protrude into the pressurizing chamber, wherein said cylinder element is pressed against said pump housing, forming at least one metal seal that delimits said pressurizing chamber, and said metal seal is provided in an outer portion of said cylinder element and spaced from ends of the cylinder.

2. The fluid pump according to claim 1, further comprising:

a pressing mechanism which presses said pump housing and said cylinder relatively so that both may be not in contact except at the metal seal, wherein said pump housing and said cylinder form said metal seal on a plane intersecting a shift direction of said plunger.

3. A fluid pump comprising:

a first member in which a concavity is formed, a second member, which defines a cylindrical body forming said concavity as a fluid pressurizing chamber, a plunger, supported in a hole extending, in the second member, from one cylindrical body end through the cylindrical body to an opposite cylindrical body end so as to reciprocate, which pressurizes the fluid in said fluid pressurizing chamber and which has an end arranged so as to move beyond an said cylindrical body end to protrude into the pressurizing chamber, a seal part formed at a pressure-contact location of said first and second members, provided in an outer portion of said second member and spaced from both the pressurizing chamber and ends of said second member, and a pressing mechanism by which said first and second members are pressed together so that the seal part delimits the pressurizing chamber.

4. A fluid pump comprising:

a pump housing, a cylinder comprising a longitudinal bore extending from one cylinder end through the cylinder to an opposite cylinder end, a pressurizing element that pressurizes the fluid in a pressurizing chamber formed between said cylinder and said pump housing and that has an end arranged so as to move beyond said one cylinder end to protrude into the pressurizing chamber, a seal part formed at a pressure-contact location between said pump housing and said cylinder, which seals the pressurizing chamber formed between said cylinder and said pump housing, and a pressing mechanism by which said pump housing and said cylinder element are relatively pressed together to install them so that the seal part delimits the pressurizing chamber.

5. The fluid pump according to claim 1, wherein a portion of said cylinder, which extends to a side of said pressurizing chamber from said metal seal, is free from seal pressure of said metal seal.

6. The fluid pump according to claim 1, further comprising:

a pressing mechanism that presses said pump housing and said cylinder relatively to form said metal seal, wherein said metal seal is formed by pressing said pump housing and said cylinder together in a plane intersecting in a shift direction of said plunger.

7. The fluid pump according to claim 3, wherein the seal part is formed by pressing said first and second members together in a plane intersecting a direction in which said plunger is reciprocated, and the pressing mechanism presses said first and second members relatively at the plane.

8. The fluid pump according to claim 7, wherein said first member is a metallic pump housing having said concavity, said second member is a metallic tube body having a hardness higher than said metallic pump housing, which forms said concavity as a fluid pressurizing chamber by assembly with said metallic pump housing, said plunger is supported by said metallic tube body so as to be able to reciprocate in an axial direction, said seal part is a metal seal formed by pressure-contact of said metallic pump housing and said metallic tube body on said plane, and said pressing mechanism presses said metallic pump housing and said metallic tube body relatively to form said metal seal.

9. The fluid pump according to claim 3, wherein said first member is made of aluminum alloy, and said second member is made of iron-system alloys having a hardness higher than that of the aluminum alloy.

10. The fluid pump according to claim 3, wherein gaps that allow thermal deformation differences caused by the thermal expansion differences between said first and second members are provided between the inner periphery of said first member and the outer periphery of the second member.

11. The fluid pump according to claim 4, wherein said seal part is formed by pressing said pump housing and said cylinder on a plane intersecting in a shift direction of said pressurizing element.

12. The fluid pump according to claim 4, wherein said seal part is a metal-contact seal provided between said pump housing and said cylinder, in an outer periphery of said cylinder, and spaced from the pressurizing chamber.

13. The fluid pump according to claim 4, wherein an inner periphery of said pump housing and an outer periphery of said cylinder are not in contact except at the seal part.

14. The fluid pump according to claim 1, wherein said fluid pump pressurizes gasoline from 5 to 20 megaPascal.

15. The fluid pump according to claim 4, wherein said fluid pump pressurizes gasoline from 5 to 20 megaPascal.

16. The fluid pump according to claim 5, wherein said fluid pump pressurizes gasoline from 5 to 20 megaPascal.

17. A fluid pump comprising:

a pump housing in which a concavity is formed, a cylinder assembled with said pump housing, which forms said concavity as a fluid pressurizing chamber, and a plunger, supported by said cylinder to reciprocate in a bore extending from one cylinder end through the cylinder to an opposite cylinder end, which pressurizes fluid in said pressurizing chamber and which has an end arranged so as to move beyond said one end to protrude into the pressurizing chamber, wherein fuel inhaled into said pressurizing chamber by reciprocation of said plunger is pressurized and discharged from said pressurizing chamber, wherein said cylinder is pressed against said pump housing so that said pressurizing chamber is formed by a seal provided by metal contact between said pump housing and said cylinder, which metal contact delimits said pressurizing chamber, and said seal is provided in an outer periphery of said cylinder and spaced from a pressurizing chamber side of said cylinder, and wherein said plunger goes into and back from said pressurizing chamber.

18. The fluid pump according to claim 17, wherein said pump housing and said cylinder are assembled so that they may be in a non-contact state at an outer periphery face of a pressurizing chamber side of said seal.

19. The fluid pump according to claim 17, wherein an annular gap is provided between opposing surfaces of said pump housing and said cylinder in a radial direction and on a pressurizing chamber side of the seal.

* * * * *